US006451137B1

(12) United States Patent
Pelissier

(10) Patent No.: US 6,451,137 B1
(45) Date of Patent: Sep. 17, 2002

(54) METHOD OF QUENCHING AFTER A LOW-PRESSURE CARBURIZATION

(75) Inventor: Laurent Pelissier, Saint Jean de Moirans (FR)

(73) Assignee: Etudes et Constructions Mecaniques, Grenoble (FR)

( * ) Notice: Subject to any disclaimer, the term of this patent is extended or adjusted under 35 U.S.C. 154(b) by 0 days.

(21) Appl. No.: 09/715,525

(22) Filed: Nov. 17, 2000

(51) Int. Cl.[7] ..... C21D 9/00

(52) U.S. Cl. ..... 148/660; 148/232; 148/233; 266/251; 266/259

(58) Field of Search ..... 148/225, 206, 148/233, 579, 660; 266/251, 257, 259

(56) References Cited

FOREIGN PATENT DOCUMENTS

| | | | |
|---|---|---|---|
| DE | 37 36 501 C1 | * | 6/1988 |
| DE | 42 08 485 C 1 | * | 2/1993 |
| FR | 91 08265 | * | 6/1991 |
| FR | 9715506 | * | 12/1997 |

OTHER PUBLICATIONS

H. Altena, "Niederdruck–Aufkohlung mit Hochdruck–Gasabschreckiung," *Carl Hanser Verlag*, 53 (1998) 2.

R. Hoffmann, H. Steinmann and D. Uschkoreit, "Moglichkeiten und Grenzen der Gasabkuhlung", *Carl Hanser Vertag*, Munchen, 1992.

* cited by examiner

*Primary Examiner*—Deborah Yee
(74) *Attorney, Agent, or Firm*—Duane Morris LLP

(57) ABSTRACT

A method for quenching steel parts having undergone a low-pressure thermal processing, which consists of submitting the parts to a high-pressure air flow.

9 Claims, 2 Drawing Sheets

METHOD OF QUENCHING AFTER A LOW-PRESSURE CARBURIZATION

BACKGROUND OF THE INVENTION

1. Field of the Invention

The present invention relates to the processing of steel parts, and more specifically to the quenching of parts having undergone thermal steps, especially of carburization, i.e. an introduction of carbon into the surface of the parts to improve their hardness. The present invention more specifically relates to the quenching of parts having undergone a carburizing process under vacuum or under a low gas pressure (lower than atmospheric pressure).

2. Discussion of the Related Art

A low-pressure carburizing process consists of submitting the parts to be processed, in an air-tight chamber, to an alternation of steps of enrichment in the presence of a low-pressure carburizing gas and of diffusion under vacuum or under a low-pressure neutral atmosphere. The respective durations of the enrichment and diffusion steps as well as their number especially depend on the desired carbon concentration and carburizing depth in the part, and such processes are well known in the art. An example of a low-pressure carburizing process is described in French patent application N° 2,678,287 of the applicant.

Any carburizing process is followed by at least one quenching step performed either in oil, or in a gas. A main purpose of the quenching is to obtain a fast cooling down of the carburized parts without altering the obtained surface state. A gas quenching is often preferred since it enables directly obtaining dry and clean parts. It is generally desired to obtain the fastest possible cooling rate. To increase the quenching speed with a given gas, the gas mass flow must be increased, that is, the speed and/or the static pressure of the quenching gas must be increased.

Among generally used quenching gases, nitrogen conventionally is an acceptable compromise in terms of cost and efficiency. Nitrogen is indeed often preferred to neutral gases such as helium and hydrogen which, although lighter, and thus easier to convey under a relatively high pressure, are too expensive (helium) or too dangerous (hydrogen).

It would however be desirable to reduce the cost of the quenching step which, due to the gas atmosphere desired to be maintained and to the required mass flow, is not negligible in the general cost of the part processing.

Further, a disadvantage of the use of a gas such as nitrogen or other is, in addition to its cost, the need for conveyance and storage of large volumes. Indeed, industrial gas quenching chambers often have volumes of several cubic meters, or even of several tens of cubic meters.

The quenching process must comply with several constraints, especially relating to the previous carburization. First, the quenching must not alter the surface hardness of the carburized part. Further, the quenching must be fast to satisfy the fast cooling down of the part and not damage its surface. Moreover, an aspect requirement of the obtained part must most often be met, this part not only generally having to have a smooth surface state, but also having to be of the color of steel (grey). In particular, the part must not have a blackened aspect, letting an oxidation be suspected.

The present invention also refers to carbonitriding, having as only difference with carburization that ammonia is generally added to the enrichment gas used. The well known result thereof is the forming of nitrides (instead of carbides for the carburization) at the part surface. It should thus by noted that all that will be discussed hereafter in relation with carburization also applies to carbonitriding.

SUMMARY OF THE INVENTION

An object of the present invention is to provide a novel quenching method that overcomes the disadvantages of known methods.

The present invention aims, in particular, at enabling implementation of a particularly economical quenching processing.

Another object of the present invention is to provide a method which is compatible with a conventional low-pressure carburizing process.

Another object of the present invention is to provide a method that respects the surface aspect of the finished parts.

To achieve these objects, the present invention provides a method for quenching steel parts having undergone a low pressure thermal process, which consists of submitting the parts to an air flow at high pressure.

According to an embodiment of the present invention, the air pressure ranges between 5 and 50 bars.

According to an embodiment of the present invention, the quenching duration is shorter than 15 minutes and, preferably, shorter than 2 minutes.

According to an embodiment of the present invention, the parts are not exposed back to air at atmospheric pressure between the low-pressure thermal process and the high-pressure air-quenching.

The present invention also provides a method for processing parts including a low-pressure carburizing process followed by a quenching step.

According to an embodiment of the present invention, the carburizing process includes an alternation of enrichment steps at low pressure in the presence of a carburizing gas and of diffusion steps in the presence of a neutral gas substantially at the same pressure as the enrichment steps.

According to an embodiment of the present invention, the parts are submitted, after the quenching step, to a shot blasting step for, especially, suppressing undesirable surface bumps.

The present invention further provides a thermal processing installation including means for implementing the above processing method.

According to an embodiment of the present invention, the installation includes several processing cells adapted to being tightly isolated from the outside, and handling means for transferring a load from one cell to another, one of these cells forming a quenching cell adapted to being further isolated from the rest of the installation to implement an air-quenching.

According to an embodiment of the present invention, the quenching cell is also used as a cell for unloading the load at the end of the processing.

The foregoing objects, features and advantages of the present invention, will be discussed in detail in the following non-limiting description of specific embodiments in connection with the accompanying drawings.

DETAILED DESCRIPTION

Figure 1A:
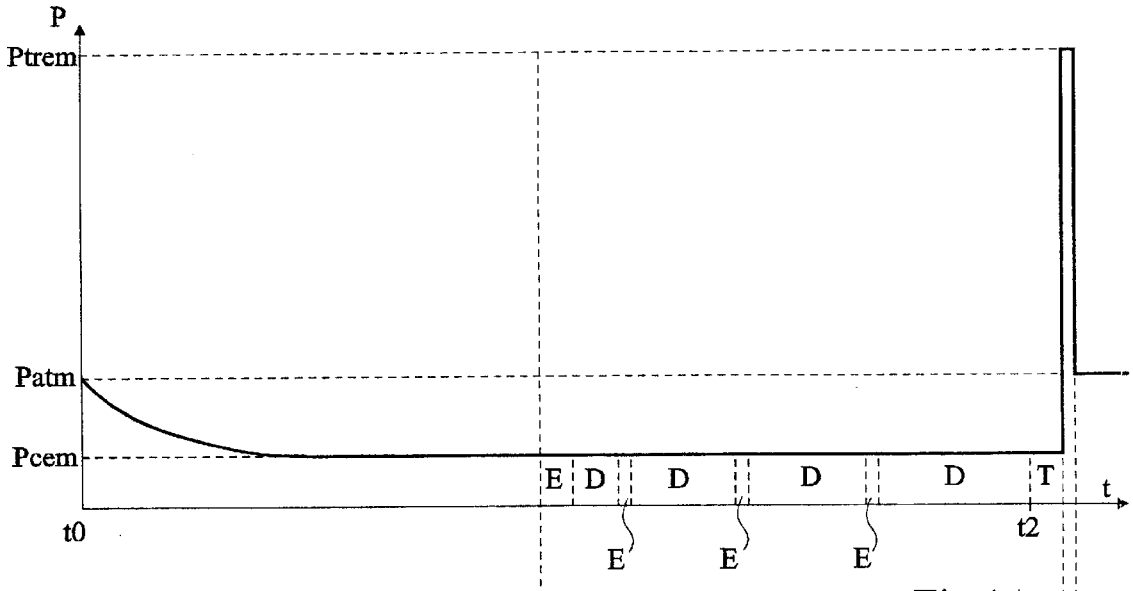
FIGS. 1A and 1B illustrate, characteristics of pressure and temperature versus time, in an example of implementation of the thermal process according to the present invention.
Figure 1B:
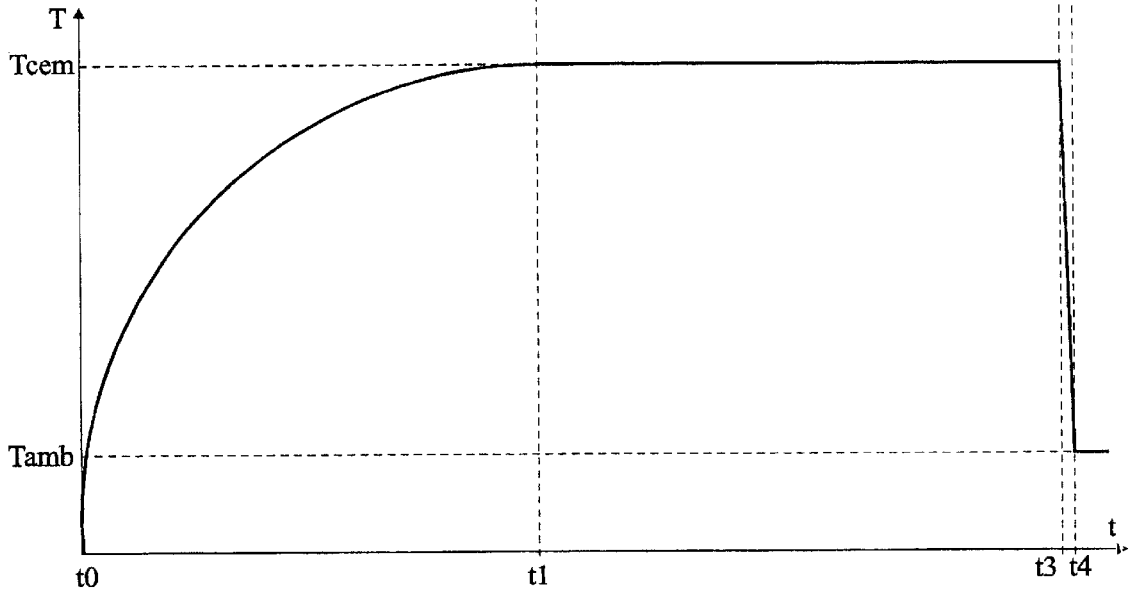

For clarity, the diagrams of FIGS. 1A and 1B are not to scale. Further, only those elements that are necessary to the understanding of the present invention have been shown in the drawings and will be described hereafter. In particular, in FIG. 2, only the multiple-cell structure of an installation has been shown, with no consideration for the details constitutive of the cells which, unless otherwise mentioned, are conventional. Further, reference will be made to patent applications to which it may be referred and the respective contents of which are integrally incorporated by reference in the present description.

A feature of the present invention is to provide a quenching under an air flow of parts having undergone a carburization or low-pressure carbonitriding. According to the present invention, this air-quenching is performed under a high pressure (greater than 5 bars).

An advantage of using air is that this is a free gas source, which is available everywhere with no particular conditioning, and inexhaustible. Thus, the cost of the quenching steps is considerably reduced as compared to conventional methods.

However, the use of air has conventionally been excluded for several reasons in gas-quenching processes in low-pressure carburizing installations or the like.

First, the presence of oxygen just after the carburization causes an oxidation which was thought to be detrimental on several accounts to the final part resulting from the quenching. An oxidation of the part modifies its hardness and makes its surface granular.

Further, in a furnace under vacuum where the carburizing and gas quenching steps are successively performed in the same enclosure, the introduction of air is not possible due to the oxidation of the hot parts of the furnace.

Further, exposing the part back to air during the entire duration of the thermal processing results in blackening its surface by oxidation, which used to be considered as crippling regarding the aspect of the part.

The present invention provides, in opposition to all these prejudices, using air for the gas quenching of the carburized part. According to the present invention, this air is used under high pressure (greater than 5 bars, and preferably between 5 and 50 bars). Another advantage of the present invention is that air can be used with very high pressures with no difficulty. Now, the fact of using a high pressure enables shortening the duration of the quenching step since the mass flow is thereby improved. According to the present invention, the duration of the air-quenching step is limited to a few minutes (typically less then 15 minutes) and is, preferably, shorter than 2 minutes. The shorter the duration, the lighter the surface oxidation of the part. It should be noted that the search for the highest possible pressure is compatible with the search for a minimum duration. With such low durations, the oxidation thickness due to the presence of air during the quenching is limited to a few micrometers. Such a thickness is negligible as compared to the carburizing thicknesses generally obtained (from several hundreds of micrometers to a few millimeters).

By accepting an oxidation over a very small thickness (less than 5 micrometers), the use of air in the quenching processing is allowed without altering the properties of the final part. Indeed, a loss of hardness over such a small thickness is generally perfectly negligible since the layer of desired hardness is located immediately under and is not altered.

Further, the parts are most often submitted to a so-called shot blasting step consisting of causing a mechanical erosion of their surface. Conventionally, this shot blasting step aims at suppressing the burrs and surface irregularities due to the casting, forging, or machining of the parts and which are more easy to suppress after the carburization due to the greater hardness of the part. According to the present invention, this step also suppresses the few oxidation micrometers due to the air-quenching. The metallic aspect of the part surface is thus recovered like at the end of a conventional nitrogen quenching.

FIGS. 1A and 1B show the respective variations of pressure and temperature in an implementation of the thermal processing method of the present invention, applied to example of processing of a steel with a 20MnCr5 grade.

According to this example, a load formed of a batch of indented drilling heads amounting to a total weight of 300 to 350 kg is introduced into a low-pressure carburizing process installation. It is desired to obtain, for these parts, a carbon content of 0.36% down to a 700-$\mu$m depth.

The load, introduced at ambient temperature Tamb (FIG. 1B) into the installation, is first brought to a temperature Tcem of 920 to 1000° C. in from 1 to 2 hours (times t0 to t1). Meanwhile, or separately if an airlock is used as will be seen hereafter in relation with FIG. 2, the pressure is lowered to a value Pcem of 5 to 20 mbar (FIG. 1A). Then, the load is submitted to five steps of enrichment (E) under a carbonated atmosphere, alternated with as many steps of diffusion (D) under nitrogen. The respective durations of the enrichment and diffusion steps are chosen conventionally and are, preferably, decreasing for the enrichment steps (for example, respectively, approximately 5 min., 2 min., 1 min. 40 s, 1 min. 35 s, and 1 min. 30 s) and increasing for the diffusion steps (for example, respectively, approximately 5 min., 10 min., 15 min., 25 min., and 40 min.). The total duration of the carburizing step is, for example, approximately 97 min. (times t1 to t2) and a carbon grade greater than 0.36% down to a 775-$\mu$m depth is obtained at the end of the carburization.

The load is then submitted to a quenching according to the present invention (times t3 to t4) under an air pressure Ptrem of approximately 16 bars for 30 seconds. Preferably, the carburizing and quenching steps are implemented in different cells. This is why, in FIG. 1A, a transfer time (T, times t2 to t3) from the carburizing cell to the quenching cell has been indicated. At the end of the processing, a steel having a surface hardness of 62–64 Hrc and a root-of-tooth hardness of 300–320 HV20 is obtained.

The quenching step results in oxidizing the surface over a thickness of less than 5 $\mu$m. Besides the fact that this depth is too small to have an influence upon the hardness of the part, it is preferably removed by a shot blasting step subsequently implemented outside of the chamber. It should be noted that the diffusion depths of carbon are generally provided with a margin enabling the shot blasting to leave a thickness in accordance with that aimed at. Thus, the present invention does not require lengthening the enrichment and diffusion steps to increase the carburizing depth to take account of the light oxidation.

To simplify, it has been assumed hereafter that the parts are brought back to the ambient temperature by the quenching step. In practice, the parts are generally taken out of the installation while still at a higher temperature. However, this changes nothing to the principles of the present invention.

As a comparison, the quenching of such a load to bring the temperature down to approximately 100° C. lasts for approximately 2 minutes under a 20-bar air pressure, and approximately 2.5 minutes under a 10-bar air pressure.

Figure 2:
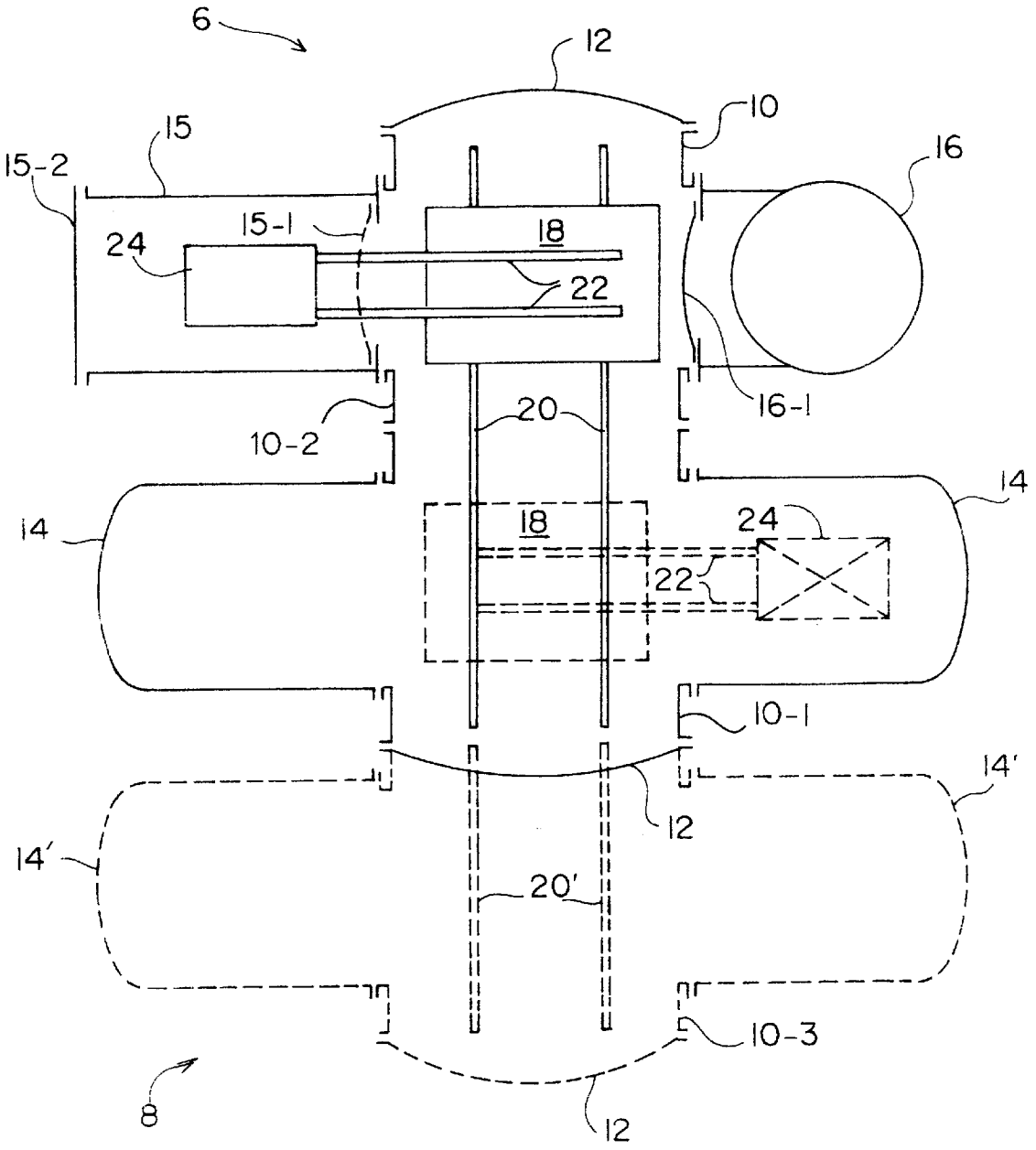
FIG. 2 very schematically shows an embodiment of a processing installation adapted to implementing the method according to the present invention.

FIG. 2 shows an example of implementation of a processing installation adapted to implementing an air-quenching according to the present invention. The embodiment of FIG. 2 is inspired from a modular installation such as described in European patent application n° 0,922,778 of the applicant to which reference can be made for further details.

A basic unit 6 includes a tight chamber 10 in the form of a cylinder (the section of which is not necessarily circular) with a horizontal axis. Both ends of cylinder 10, provided with flanges, are obturated by removable tight covers 12. Processing cells are laterally connected to cylinder 10 and are located in a same horizontal plane. For example, two thermal processing cells 14 (for example, to contain two loads to be carburized) are arranged opposite to each other by being connected to a first transfer caisson 10-1 constitutive of cylinder 10. A loading-unloading cell 15 is arranged opposite to a quenching cell 16, these cells being connected to a second transfer caisson 10-2, itself axially connected to caisson 10-1.

A handling device is in the form of a carriage 18 moving in a direction parallel to the axis of cylinder 10, from one transfer caisson to another. This carriage moves, for example, on rails 20 extending all along cylinder 10. The carriage is provided with a telescopic fork 22 likely to extend on either side of carriage 18 to reach the center of each of cells 14 to 16 to take therefrom and deposit thereinto a load 24 being processed. In FIG. 2, in full lines, carriage 18 is located at the level of cells 15 and 16, and telescopic fork 22 penetrates into cell 15 to take a load 24 therefrom. Of course, cell 15 has been previously put to the low pressure of chamber 10 to be able to open door 15-1 which forms, with outer door 15-2, an entry lock. In dotted lines, carriage 18 is located at the level of cells 14. An installation such as illustrated in FIG. 2 is modular, that is, one or several additional units 8 each formed of a transfer caisson 10-3 provided with rails 20' and with one or two cells 14' may be axially connected to one of caissons 10-1 or 10-2 to complete cylinder 10.

The only modification to be brought to an installation such as described in above-mentioned European patent application EP-A-0,922,778, to implement the present invention, is to provide means for organizing a circulation of air under pressure in quenching cell 16 and, according to a preferred embodiment, means for putting this cell back under vacuum before a new load is introduced and/or before the load can return to transfer caisson 10-2. Cell 16 can be isolated from the rest of the installation by a tight door 16-1.

As an alternative, the quenching cell is also a carburizing cell. However, it will generally be preferred to provide distinct cells and thus reduce the processing time. Indeed, it can then be provided for one load or several loads to undergo a carburization in an adapted cell while another preceding load is being quenched.

According to another alternative, the quenching cell may be provided to form the exit lock of a multiple-cell installation. Indeed, the quenching step generally is the last processing step within the installation. In the case of an installation such as that of above-mentioned European patent application EP-A-0,922,778, this is compatible with the quenching of a load at the same time as the carburization of one or several following loads. The only modification to be made concerns the quenching cell (16, FIG. 1) to which a door for unloading to the outside must then be adapted.

An advantage of using the quenching cell as an exit lock is that the transfer caissons, which form large volumes (several tens of cubic meters) can then remain under vacuum or under a low-pressure controlled atmosphere. Further, time is saved by not having the load once cooled down go back through the transfer caissons.

Further, since the conventional structure of loading/unloading cell 15 needs not be modified, the latter can still be used as an exit lock, for example, if the quenching step is not the last one in the processing applied to the inside of the installation. An advantage of dissociating the entrance and exit locks is that this eases the organization of the load handling outside of the installation and the association of this installation with the rest of the part manufacturing line.

Of course, the present invention is likely to have various alterations, modifications, and improvements which will readily occur to those skilled in the art. In particular, although the present invention has been described in relation with a low-pressure carburizing process, it more generally applies to any processing in which similar problems are posed, in particular in which a quenching under a neutral gas, under nitrogen or the like is currently provided after a low-pressure processing. This may for example be a carbonitriding, a soldering and other applications under partial vacuum before quenching.

Further, adapting the implementation data of the quenching method of the present invention according to the type of parts, to the load volume, and to the preceding processings is within the abilities of those skilled in the art based on the functional indications given hereabove. In particular, it should be noted that the numerical indications of the previously indicated specific example are an illustration only of the feasibility of the present invention, and that other values may be adopted, including for the processing of this type of steel. It should also be noted that the air composition is generally not critical. Indeed, the compositions of the atmospheric air of the different regions in the world are rather close (at least as concerns the compounds of interest for the present invention) and require in most cases no specific adaptation. In an extreme case, the quenching time and/or the air pressure and/or the circulation speed may be adapted to the oxygen content of the air. Of course, the air used is nevertheless filtered to avoid introducing impurities into the installation. Further, the air will be dried if necessary to reduce oxidation risks.

Moreover, the practical implementation of a processing installation of the present invention and its adaptation to the concerned application is within the abilities of those skilled in the art based on the functional indications given hereabove. In particular, the choice of the part loading/unloading mode depends on the application and, generally, on a compromise between the general bulk of the installation and the processing duration for one part. Finally, it should be noted that the present invention can also be implemented in a processing installation of the type described in European patent application n° 0,388,333 of the applicant where several vertical processing cells are distributed above a tight load transfer chamber and on either side of the quenching cell. The adaptation of such an installation to the present invention simply requires, as for the installation described in relation with FIG. 2, association with the quenching cell of means for organizing the circulation of air under pressure and, preferably, also evacuating this cell.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method for quenching steel parts having undergone a thermal processing at low pressure (Pcem), consisting of:

submitting the parts to an air flow at high pressure (Ptrem), wherein the quenching duration (t4–t3) is shorter than 15 minutes.

2. The method according to claim 1, wherein the quenching duration (t4–t3) is shorter than two minutes.

3. A method for quenching steel parts having undergone a thermal processing at low pressure (Pcem), consisting of:

submitting the parts to an air flow at high pressure (Ptrem), wherein the parts are not exposed back to air at atmospheric pressure (Patm) between the low-pressure thermal processing and the air-quenching at high pressure.

4. A method for processing parts including a low-pressure carburizing process followed by a quenching step, wherein the quenching step is that of claim 3.

5. The processing method of claim 4, wherein the carburizing process includes an alternation of enrichment steps (E) at low pressure (Pcem) in the presence of a carburizing gas and of diffusion steps (D) in the presence of a neutral gas substantially at the same pressure as the enrichment steps.

6. The processing method of claim 4, wherein the parts are submitted, after the quenching step, to a shot blasting step for, especially, suppressing undesirable surface bumps.

7. A thermal processing installation including means for implementing the processing method of claim 4.

8. The thermal processing installation of claim 7, including several processing cells (14, 15, 16) adapted to being tightly isolated from the outside, and handling means (18, 20, 22) for transferring a load (24) from one cell to another, one of these cells forming a quenching cell (16) adapted to being further isolated from the rest of the installation to implement the air-quenching.

9. The thermal processing installation of claim 8, wherein the quenching cell (16) is also used as a cell for unloading the load (24) at the end of the processing.

* * * * *

UNITED STATES PATENT AND TRADEMARK OFFICE

CERTIFICATE OF CORRECTION

PATENT NO. : 6,451,137 B1
DATED : September 17, 2002
INVENTOR(S) : Laurent Pelissier It is certified that error appears in the above-identified patent and that said Letters Patent is hereby corrected as shown below:

Title page,
Insert Item -- [30] Foreign Application Priority Data
November 17, 1999 France 99/14449 --

Signed and Sealed this

First Day of April, 2003

JAMES E. ROGAN
*Director of the United States Patent and Trademark Office*